US008919996B2

(12) United States Patent
Kim

(10) Patent No.: US 8,919,996 B2
(45) Date of Patent: Dec. 30, 2014

(54) LED LIGHTING MODULE AND LIGHTING LAMP USING SAME

(75) Inventor: Hyunmin Kim, Seoul (KR)

(73) Assignee: Solarkor Company Ltd., Seoul (KR)

( * ) Notice: Subject to any disclaimer, the term of this patent is extended or adjusted under 35 U.S.C. 154(b) by 0 days.

(21) Appl. No.: 13/637,194

(22) PCT Filed: Mar. 24, 2011

(86) PCT No.: PCT/KR2011/002020

§ 371 (c)(1),
(2), (4) Date: Sep. 25, 2012

(87) PCT Pub. No.: WO2011/118992

PCT Pub. Date: Sep. 29, 2011

(65) Prior Publication Data

US 2013/0020462 A1 Jan. 24, 2013

(30) Foreign Application Priority Data

Mar. 26, 2010 (KR) ..... 10-2010-0027582
Mar. 21, 2011 (KR) ..... 10-2011-0024773

(51) Int. Cl.

| | |
|---|---|
| ***F21S 4/00*** | (2006.01) |
| ***F21K 99/00*** | (2010.01) |
| ***F21V 29/00*** | (2006.01) |
| ***F21V 19/00*** | (2006.01) |
| *F21V 23/04* | (2006.01) |
| *F21Y 111/00* | (2006.01) |
| *F21Y 101/02* | (2006.01) |
| *F21Y 103/00* | (2006.01) |

(52) U.S. Cl.

CPC ..... *F21K 9/13* (2013.01); *F21V 23/045* (2013.01); *F21Y 2111/005* (2013.01); *F21V 23/0435* (2013.01); *F21V 23/0464* (2013.01); *F21Y 2101/02* (2013.01); *F21V 29/2293* (2013.01); *F21Y 2103/003* (2013.01); *F21V 19/003* (2013.01)

USPC ..... 362/249.02; 362/294

(58) Field of Classification Search

USPC ..... 362/249.02, 294

See application file for complete search history.

(56) References Cited

U.S. PATENT DOCUMENTS 5,567,036 A * 10/1996 Theobald et al. ..... 362/485
6,533,445 B1 * 3/2003 Rogers ..... 362/540

(Continued)

FOREIGN PATENT DOCUMENTS

JP 2008-500705 A 1/2008
KR 100939477 B1 1/2010

OTHER PUBLICATIONS

English Abstract for KR 100939477, Jan. 29, 2010.

(Continued)

*Primary Examiner* — Evan Dzierzynski
(74) *Attorney, Agent, or Firm* — Novick, Kim & Lee, PLLC; Jae Youn Kim

(57) ABSTRACT

An LED lighting module formed by combining components into an integrated type to achieve efficiency in light emission-light diffusion-heat dissipating operations is provided. Also, a lighting lamp is provided in which a plurality of LED lighting modules are combined to enable wide light distribution, and heat generated from the lighting lamp can be convected through a plurality of vent holes formed in all side surfaces of the lamp to achieve improved illumination efficiency and lengthen the lifespan of the lamp to tens of thousands of hours. For this, the LED lighting module is formed by combining, into an integrated type, an LED module in which a plurality of vertical projection type and side projection type LED elements are arrayed, a light diffusion cover having blades protruded from the left and right sides thereof, and a thin heat dissipating plate, thereby obtaining a lightweight and economically advantageous lighting module.

6 Claims, 9 Drawing Sheets

(56) References Cited

U.S. PATENT DOCUMENTS

| | | | | |
|---|---|---|---|---|
| 7,562,998 | B1 * | 7/2009 | Yen | 362/219 |
| 7,914,162 | B1 * | 3/2011 | Huang | 362/92 |
| 7,988,322 | B2 * | 8/2011 | Zheng | 362/218 |
| 8,215,795 | B2 * | 7/2012 | Pichel | 362/249.02 |
| 2006/0109662 | A1 * | 5/2006 | Reiff et al. | 362/373 |
| 2008/0180955 | A1 * | 7/2008 | Shuy | 362/294 |
| 2008/0205062 | A1 * | 8/2008 | Dahm et al. | 362/294 |
| 2009/0219713 | A1 * | 9/2009 | Siemiet et al. | 362/218 |

OTHER PUBLICATIONS

English Abstract for JP2008-500705.

* cited by examiner

LED LIGHTING MODULE AND LIGHTING LAMP USING SAME

TECHNICAL FIELD

The present invention relates to a Light-Emitting Diode (LED) lighting module using an LED element as a light-emitting body and a lighting lamp using the LED lighting module and, more particularly, to an economic LED lighting module and a lighting lamp using the LED lighting module, wherein if a lighting lamp of a polygonal shape is configured by combining the LED lighting modules in each of which [light emission-light diffusion-heat dissipation] actions are efficiently performed in integrally combined LED lighting modules, wide backlight is performed in all directions 180 degrees through the plurality of lighting modules, the dissipation of heat is smoothly performed by convection current in all directions through a plurality of vent holes for heat dissipation formed on the left and right sides of the lighting modules and projection type wings formed on the left and right sides of each of the lighting modules, and the light efficiency and the lifespan of the lamp are stably maintained for several tens of thousands of hours or more irrespective of the direction of the lamp used.

BACKGROUND ART

An LED lighting lamp rapidly replaces lighting apparatus that uses conventional light sources, such as a fluorescent lamp and an electric lamp, owing to its advantages of high energy efficiency and a long lifespan. An LED element used in the LED lighting lamp has advantages, such as the amount of emission heat smaller than that of a conventional lighting light source, low consumption power, a long lifespan, and a shock-resistance property. Furthermore, the LED element is advantageous in that it does not generate environment pollutions because mercury or gas for discharge is not used like in a fluorescent lamp in its manufacture process.

If a proper power and heat dissipation means are provided, an LED element can maintain a turn-on state without a loss although it is used for ten thousand hours or more. The light outputs of all light sources are gradually reduced over time. A person does not feel a reduction of the light output up to 80% of an initial luminous intensity. If an evaluation is performed based on the above, a lifespan for lighting of an LED element is expected to be forty thousand to fifty thousand hours or more. Accordingly, the LED element can be said to be a light source having a very long lifespan as compared with an electric lamp of 1,500 hours and a fluorescent lamp of ten thousand hours.

If a driving current is increased in an LED element in order to obtain a high brightness, high output, and economic light source for lighting, however, most of electrical energy is converted into heat and the joint portions of the LED elements become a high temperature state because a power loss in the LED elements is increased. The LED element is characterized in that if temperature of the joint portion rises although a current is constant, light output and light efficiency are deteriorated and an operation lifespan is also reduced. Accordingly, in order to improve lighting performance and an operation lifespan, it is necessary to discharge heat, generated from the joint portions of the LED elements, externally as soon as possible.

In general, an LED lighting lamp of an electric bulb type, having a small size and a small internal space, has a structural disadvantage in externally discharging heat generated from LED elements as compared with lighting of other forms.

Accordingly, to increase the light output by mounting a large number of LED elements on a lighting lamp of an electric bulb type or a compact type has a limit to a mounting area and a heat dissipation area. Accordingly, there are problems in that it is difficult to obtain a lighting light source of high brightness and light from the LED elements, that is, light sources, is changed and the lifespan of the LED elements is reduced because heat is easily accumulated within the lighting lamp when the lighting lamp is mounted on lighting apparatus.

Furthermore, in a common LED lighting lamp, a light-emission unit was constructed by arranging high-brightness LED elements in the front surface of a heat dissipation frame in which a plurality of cooling pins is formed and the lighting lamp was fabricated by covering the light-emission unit with a milk-white diffusion cover in order to reduce dazzling. However, this method is problematic in that there is a great luminance difference at the time of lighting because the backlight of the light-emission unit is narrowly formed in all directions, luminance is low due to a great light loss resulting from the dark milk-white diffusion cover, an the lifespan of the lamp of the LED element is reduced because heat is also accumulated within the diffusion cover.

Furthermore, the mounting area is limited because a circuit board in which a plurality of LED elements is arranged is mounted on the front of the heat dissipation frame, which makes it difficult to dispose a large number of LED elements. For this reason, in order to obtain a large amount of light using a limited number of LED elements, expensive and high-brightness LED elements must be used or the size of the heat dissipation frame must be further increased. As a result, there are problems in that the lighting lamp becomes heavy and bulky and it is difficult to popularize the lighting lamp due to a high price result from a high manufacture cost.

Accordingly, in order to greatly expand power-saving and eco-friendly LED lighting environment by replacing the existing electric lamp and compact type fluorescent lamp, the improvement of light efficiency of an LED lighting lamp, a wide backlight condition without dazzling, and lighter, efficient, and economic heat dissipation means must be prepared.

DISCLOSURE

Technical Problem

The present invention the present invention is to provide an LED lighting module, including an LED module configured to have a plurality of LED elements arranged in a circuit board having a connector for power connection provided on one side thereof and formed of a surface light-emission body, a light diffusion cover configured to cover the upper side of the LED module in a semi-cylindrical shape and have projection wings formed on the left and right sides thereof, respectively, and a heat dissipation plate combined to cover the lower side of the LED module, configured to have an edge thereof inserted into the bottom edge of the light diffusion cover and fixed to the bottom of the light diffusion cover, and made of metal, wherein the LED module, the light diffusion cover, and the heat dissipation plate are integrally combined.

A lighting lamp using the LED lighting module in accordance with the present invention a lighting lamp using the LED lighting module, including a power module housing configured to have a power connection base fixed on one side thereof, a power module installed within the power module housing, a circular shielding plate configured to cover the lower portion of the power module, fixed to the power module housing, and configured to have a plurality of holes for connectors formed on its circumference, a housing cover configured to cover the circular shielding plate, fixed to the power module housing, and configured to have a plurality of vent holes formed on its edges and lower circumference and have two or more module insertion holes formed at the bottom surface thereof, an LED lighting module inserted into and fixed to the module insertion holes of the housing cover and connected to the power module and a power source by connectors, wherein two or more lighting modules are inserted into the module insertion holes of the housing cover to form a lamp type light-emission unit of a polygonal structure, a plurality of vent holes for heat dissipation formed at edges on the left and right sides of each of the lighting modules so that projection type wings formed on the left and right sides of the LED lighting modules come contact with each other when the LED lighting modules are combined to form a cylindrical light-emission unit, and the bottom cover detachably and attachably combined to the lower side of the LED lighting module and configured to support an assembled light-emission unit and have one or more vent holes for heat dissipation formed in its bottom surface, so that backlight of 180 degrees and heat is dissipated by convection current in all directions.

Technical Solution

An embodiment of the present invention provides an LED module configured to have a plurality of LED elements arranged in a circuit board having a connector for power connection provided on one side thereof and formed of a surface light-emission body, a light diffusion cover configured to cover the upper side of the LED module in a semi-cylindrical shape and have projection wings formed on the left and right sides thereof, respectively, and a heat dissipation plate combined to cover the lower side of the LED module, configured to have an edge thereof inserted into the bottom edge of the light diffusion cover and fixed to the bottom of the light diffusion cover, and made of metal, wherein the LED module, the light diffusion cover, and the heat dissipation plate are integrally combined.

In the embodiment of the present invention, the plurality of LED elements arranged in the LED module is provided to project light sources upwardly. Here, if one or more side projection type LED elements for projecting light sources to one side of the light diffusion cover are provided on one side of the LED module, when configuring a lighting lamp in accordance with the present invention, a large amount of a light source is projected to not only the circumference of the light-emission unit, but also the downward direction of the light-emission unit. It is useful because wide backlight of 180 degrees with no light blind spot is performed.

In the embodiment of the present invention, it is useful to a light diffusion action to further include a module reflection plate supported to the inner surface of the light diffusion cover and configured to cover the LED module, wherein a face corresponding to the light-emission surfaces of the LED elements arranged in the LED module becomes a transparent window and the remainder bottom surface is subject to reflection processing or the transparent window portion of the reflection plate is perforated.

In the embodiment of the present invention, the light diffusion cover is made of transparent, semi-transparent, or milk-white material depending on a use of lighting, and it is used to form a diffusion lens in the inner curved surface of the light diffusion cover in order to widely diffuse the light sources of the LED elements.

In the embodiment of the present invention, heat dissipation ceramics, carbon, or another heat dissipation material for switching heat energy to radiation energy is coated on the outer surface of the heat dissipation plate in order to improve the heat dissipation ability. In this case, it is useful to reduce weight in a lighting lamp having the same light output and to fabricate the heat dissipation plate more cheaply.

Furthermore, the heat dissipation plate is formed of a thin metallic plate having excellent thermal conductivity and provided as a heat dissipation plate having thermal conductive adhesives coated on one side of the thin metallic plate and heat dissipation ceramics, carbon, or another heat dissipation material is coated or covered on the other side of the thin metallic plate. It is useful to reduce a production cost by adhering the heat dissipation plate to the edge of the light diffusion cover and the bottom surface of the LED module at the same time when fabricating a lighting module in order to seal the inside of the lighting module and use the heat dissipation plate as heat dissipation material.

An embodiment of a lighting lamp using the LED lighting module in accordance with the present invention includes a lighting lamp using the LED lighting module, including a power module housing configured to have a power connection base fixed on one side thereof, a power module installed within the power module housing, a circular shielding plate configured to cover the lower portion of the power module, fixed to the power module housing, and configured to have a plurality of holes for connectors formed on its circumference, a housing cover configured to cover the circular shielding plate, fixed to the power module housing, and configured to have a plurality of vent holes formed on its edges and lower circumference and have two or more module insertion holes formed at the bottom surface thereof, an LED lighting module inserted into and fixed to the module insertion holes of the housing cover and connected to the power module and a power source by connectors, wherein two or more lighting modules are inserted into the module insertion holes of the housing cover to form a lamp type light-emission unit of a polygonal structure, a plurality of vent holes for heat dissipation formed at edges on the left and right sides of each of the lighting modules so that projection type wings formed on the left and right sides of the LED lighting modules come contact with each other when the LED lighting modules are combined to form a cylindrical light-emission unit, and the bottom cover detachably and attachably combined to the lower side of the LED lighting module and configured to support an assembled light-emission unit and have one or more vent holes for heat dissipation formed in its bottom surface, so that backlight of 180 degrees and heat is dissipated by convection current in all directions.

In the embodiment of the lighting lamp in accordance with the present invention, a doughnut-shaped bottom cover having a lattice type vent hole formed at the center of the bottom cover is provided instead of the bottom cover, and a bottom cover equipped with a doughnut-shaped LED lighting module for projecting a lighting light source in a downward direction is provided within the doughnut-shaped bottom cover and mounted on the lighting lamp. In this case, it is useful because a greater amount of a lighting light source can be projected in the downward direction of the lighting lamp.

In the embodiment of the lighting lamp in accordance with the present invention, it is useful to further include a heat-blocking cover disposed within the light-emission unit of the lighting lamp at the center of the circular shielding plate and configured to block radiation heat rising toward the circular shielding plate and switch a direction of emission heat to side vent holes of the housing cover.

In the embodiment of the lighting lamp in accordance with the present invention, the LED lighting modules mounted on the cylindrical light-emission unit of the lighting lamp illuminate respective side circumferences of the lighting lamp, and a light-emission light source of a side projection type LED element provided on one side of each of the LED lighting modules projects a lighting light source toward the downward direction of the lighting lamp. In this case it is useful because backlight of 180 degrees is performed.

In the embodiment of the lighting lamp in accordance with the present invention, the bottom cover comprises a photo sensor for automatically controlling luminance, and lighting luminance and color rendering are changed by a manipulation of a remote controller through the photo sensor. It is useful to utilize the lighting lamp.

In the embodiment of the lighting lamp in accordance with the present invention, the LED lighting module is easily replaceable by attaching or detaching the housing cover and the bottom cover. In this case, it is useful to reduce wastes and reduce resources in terms of a global environment.

Advantageous Effects

The LED lighting module in accordance with the present invention is an integration type light-emission module in which [light emission-light diffusion-heat dissipation] actions are efficiently performed. The LED lighting module is advantageous in that the manufacture of the lighting lamp assembled according to a use of lighting is easy, the weight of the lighting lamp is reduced, and the manufacture cost can be greatly reduced because the lighting module in which light output, light diffusion, and a heat dissipation ability are optimized can be standardized and provided.

The lighting lamp using the LED lighting module according to the present invention is advantageous in that it rarely has dazzling because a plurality of the LED lighting modules in accordance with the present invention is cylindrically combined to form wide backlight of 180 degrees and the light efficiency and lifespan of the LED element, that is, a light source, are stably maintained irrespective of the direction of the lighting lamp used and thus the lighting lamp can be used semi-permanently because heat is rapidly dissipated by convection current in all directions through the plurality of vent holes formed on the side and bottom of the light-emission unit.

The lighting lamp using the LED lighting module according to the present invention has an advantage in that it can reduce wastes and has an environmental effect contributable to a reduction of resources because a lighting module having an expired lifespan can be replaced with an assembly structure in which a plurality of lighting modules is combined and thus the housing and parts of the lighting lamp can be reused.

The lighting lamp using the LED lighting module according to the present invention is advantageous in that it can reduce electricity and resources and improve a global environment because the existing electric lamp and compact type fluorescent lamp can be replaced with the lighting lamp having wide backlight of small dazzling and a semi-permanent lifespan.

MODE FOR INVENTION

Figure 1:
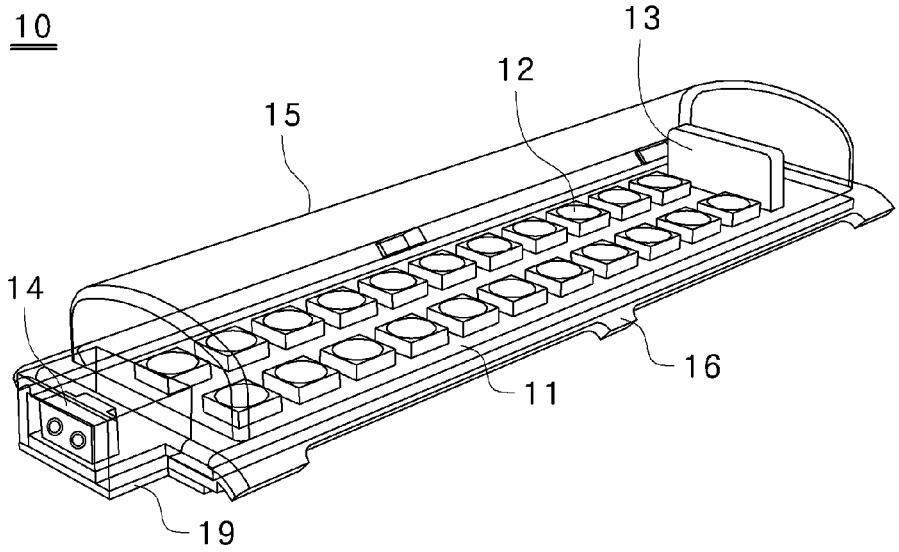
FIG. 1 is a perspective view showing a LED lighting module in accordance with an embodiment of the present invention.
Figure 2:
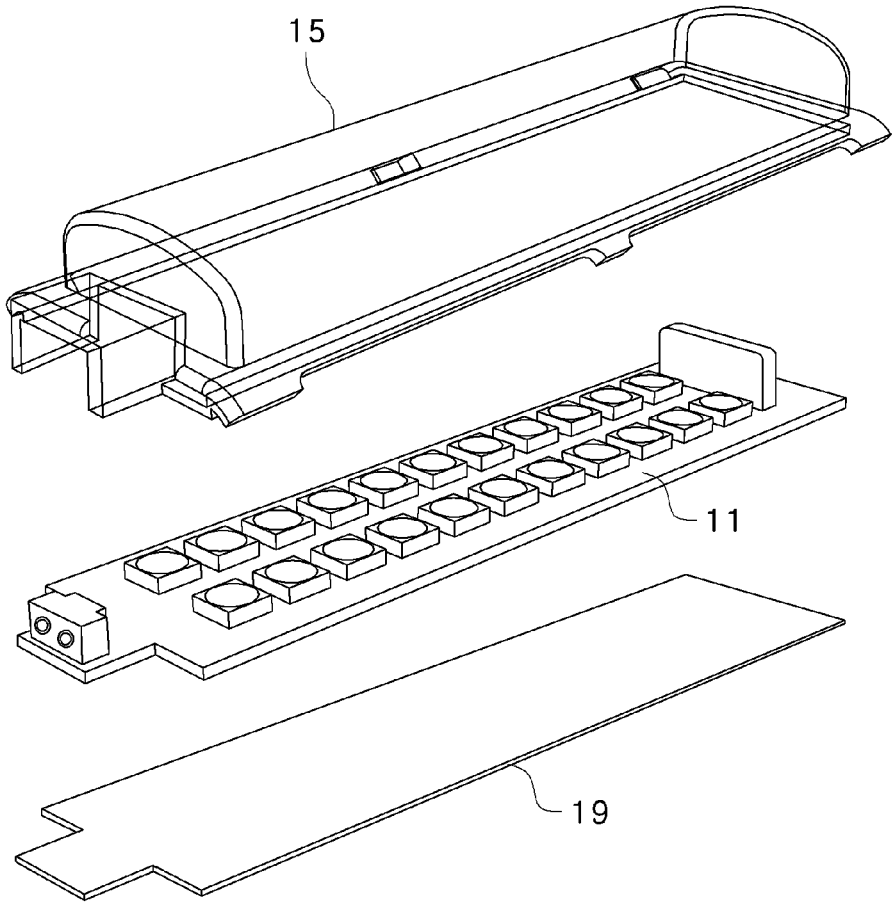
FIG. 2 is an exploded view showing the elements of FIG. 1.
Figure 3:
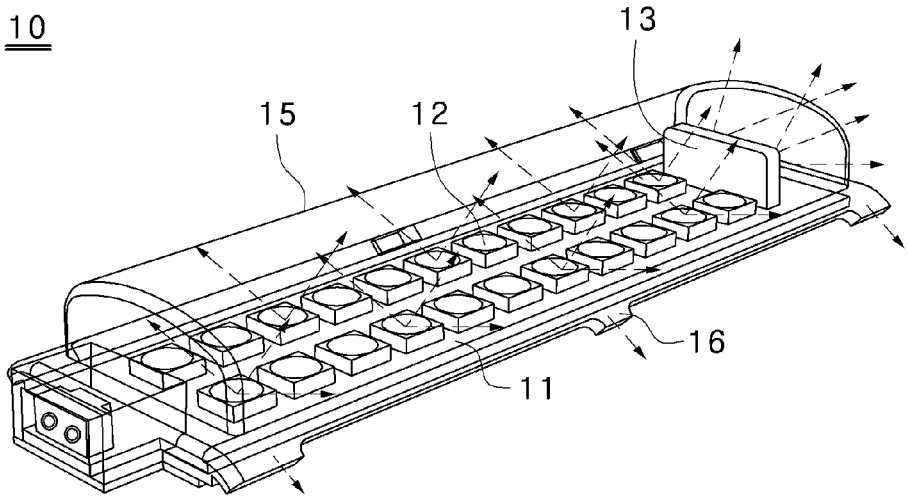
FIG. 3 is a perspective view showing the state in which light is generated from the LED elements shown in FIG. 1.
Figure 4:
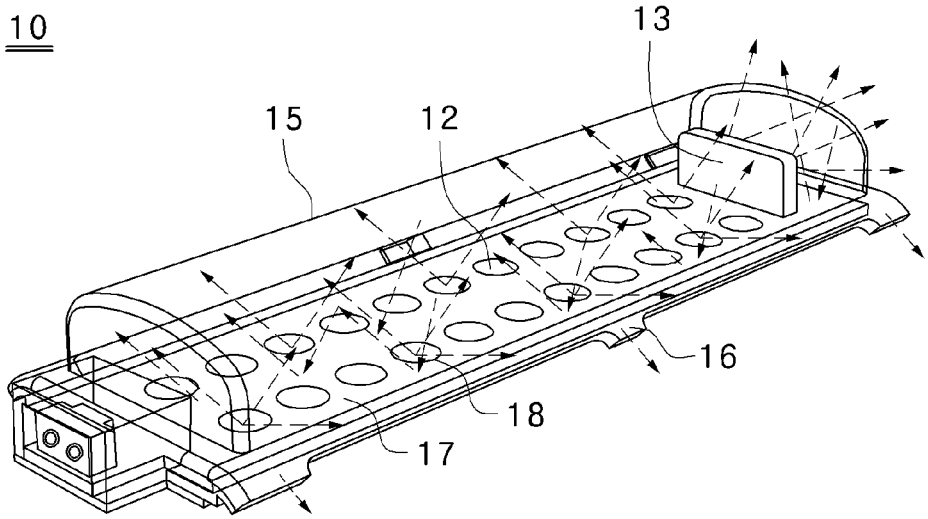
FIG. 4 is a perspective view showing the state in which a module reflection plate is covered over all the LED elements shown in FIG. 1 and light emission and reflection are generated.

FIG. 1 is a perspective view showing a LED lighting module in accordance with an embodiment of the present invention, FIG. 2 is an exploded view showing the elements of FIG. 1, FIG. 3 is a perspective view showing the state in which light is generated from the LED elements shown in FIG. 1, and FIG. 4 is a perspective view showing the state in which a perforation reflection plate is covered over all the LED elements shown in FIG. 1 and light emission and reflection are generated.

The LED lighting module 10 in accordance with a preferred embodiment of the present invention, as shown in FIGS. 1 to 2, forms an integration type lighting module in which a plurality of vertical projection type LED elements 12 and a side projection type LED element 13 are arranged, an LED module 11 having a connector 14 on one side, a light diffusion cover 15, and a heat dissipation plate 19 are combined in a heat dissipation circuit board, so that the elements are optimized and standardized for each module according to a use of lighting and [light emission-light diffusion-heat dissipation] actions are efficiently performed.

The construction and operation of the LED lighting module in accordance with the present invention are described below in detail. The LED module 11 configured to have the plurality of vertical projection type LED elements 12 and the side projection type LED element 13 arranged to form a surface light-emission body in the heat dissipation circuit board having the connector 14 for power connection provided on one side thereof, the light diffusion cover 15 configured to cover the upper side of the LED module 11 in a semi-cylindrical shape and have one or more projection wings 16 formed on the left and right sides thereof, respectively, and the heat dissipation plate 19 combined to cover the lower side of the LED module 11 and configured to have the edge thereof inserted into the bottom edge of the light diffusion cover 15 and fixed to the bottom of the light diffusion cover 15 are integrally combined, thereby forming the lighting module for a lighting lamp.

In the embodiment of the present invention, when the LED module 11 is covered with the light diffusion cover 15, the edge of the LED module 11 is fit into the inner bottom edge of the light diffusion cover 15, so that external air is not introduced into the inner space of the light diffusion cover 15. Accordingly, the light-emission unit is not contaminated although it is used for a long period. In addition, the heat dissipation plate 19 is adhered to the bottom surface of the LED module 11 by a thermal conductive tape TIM TAPE, and thus the edge of the LED module 11 is fit into the bottom edge of the light diffusion cover 15. Since the LED module 11 is closely protected up and down, moisture or dust is not introduced into the inside of the light-emission unit and the inside of the light-emission unit is electrically insulated from the outside. Accordingly, the lighting module is stably protected and electrically insulated, and it is safe for the human body.

In the embodiment of the present invention, heat dissipation ceramics, carbon, or another heat dissipation material for converting heat energy into radiation energy is coated on the outer surface of the heat dissipation plate 19 made of metal in order to improve a heat dissipation ability. Accordingly, the weight of the lighting lamp heat dissipation materials and a manufacture cost can be preferably reduced. A plurality of heat dissipation pins is formed in the outer surface of the heat dissipation plate 19 and the heat dissipation material is coated thereon in order to improve a heat dissipation ability.

Furthermore, in the embodiment of the present invention, the heat dissipation plate 19 made of metal is formed of a thin metallic plate formed by thinly rolling copper or aluminum having excellent thermal conductivity like paper, and a heat radiation sheet having thermal conductive adhesives coated on one side thereof and heat dissipation ceramics, carbon, or another heat dissipation material coated or covered on the other side thereof is provided as the heat dissipation plate 19. If the heat dissipation plate 19 is adhered to the edge of the light diffusion cover and the bottom surface of the LED module at the same time and used as the heat dissipation material for sealing the inside of the lighting module when the lighting module is fabricated, the LED lighting module 10 of the present invention can be fabricated more economically and thus the production cost of the lighting lamp can be usefully reduced as compared with a heat dissipation effect.

In particular, a standardized module is previously fabricated in unit of light output and the LED lighting module 10 of the present invention is combined and assembled into the power module housing cover of the lighting lamp according to a use of lighting. Accordingly, the LED lighting module can be mass produced while sufficiently satisfying the combination property and airtightness of the elements. As a result, the lighting module has high efficiency, and the manufacture cost of the lighting lamp can be reduced.

FIG. 3 is a perspective view showing the state in which light is generated from the LED elements shown in FIG. 1. The plurality of vertical projection type LED elements 12 arranged in the LED module 11 projects light sources upwardly from the semi-cylindrical light diffusion cover 15, and the side projection type LED element 13 disposed on one side of the LED module 11 projects a light source toward the end part of the light diffusion cover 15. If a lighting lamp is constructed by combining a plurality of the LED lighting modules, the plurality of vertical projection type LED elements 12 emits light to the circumference of the side of the lighting lamp and the side projection type LED element 13 emits light downwardly from the lighting lamp, thereby forming wide backlight of 180 degrees without a light blind spot. Arrows indicated by dotted lines in the drawing indicate the projected light sources.

In particular, in the LED lighting module 10 of the present invention, as shown in FIGS. 3 and 4, the one or more projection type wings 16 are formed on the left and right sides of the semi-cylindrical light diffusion cover 15 in order to discharge the heat of the lighting lamp and reduce a light blind spot. Light sources projected toward the left and right sides of the light diffusion cover 15 by internal reflection within the light diffusion cover 15 are induced into the end parts of the projection type wings 16. Thus, if a lighting lamp is constructed by combining the plurality of LED lighting modules 10 in a cylindrical shape, the projection type wings 16 formed on the left and right sides of the LED lighting modules 10 come in contact each other. Accordingly, vent holes are formed over and under the projection type wings 16, and the lateral reflection light of the light diffusion cover 15 is induced into the circumference of each of the vent holes and the projection type wings 16. As a result, although a plurality of the vent holes is placed in each of the sides of the lighting lamp, there is an advantage in that light sources are widely diffused over the entire light-emission unit without a light blind spot.

FIG. 4 is a perspective view showing the state in which a module reflection plate is covered over all the LED elements shown in FIG. 1 and light emission and reflection are generated. In order to further increase the light diffusion action of the LED lighting module 10 shown in FIG. 3, the module reflection plate is covered over the LED module 11.

In the embodiment of the present invention, the module reflection plate 17 is supported to both ends of the semi-cylindrical light diffusion cover 15, thus covering the LED module 11. A face that corresponds to the light-emitting body of the LED elements 12 arranged in the LED module 11 becomes a transparent window, and the remainder bottom surface is subject to reflection processing or perforation holes 18 are perforated in the transparent window portion, thus forming the module reflection plate 17. When the light sources projected from the respective LED elements 12 are projected onto the inner face of the semi-cylindrical light diffusion cover 15 after passing through the perforation holes 18, part of the light goes straight, part of the light is reflected from the curved surface by means of the lens action of the semi-cylindrical curved surface, and thus the light is reflected again by the module reflection plate 17 having excellent reflection efficiency. Accordingly, it is preferred that the module reflection plate 17 be applied to the LED lighting module because a uniform light diffusion effect having a minimum light loss can be obtained.

In the embodiment of the present invention, the light diffusion cover 15 is made of transparent, semi-transparent or milk-white material depending on a use of lighting. Here, a plurality of diffusion lenses, such as saw-toothed lenses, lenticular lenses or convex lenses, is formed on the inner face of the light diffusion cover 15 in order to widely diffuse the light sources of the LED elements 12 and 13. Accordingly, a light loss can be reduced, and a uniform light diffusion effect can be obtained.

Figure 5:
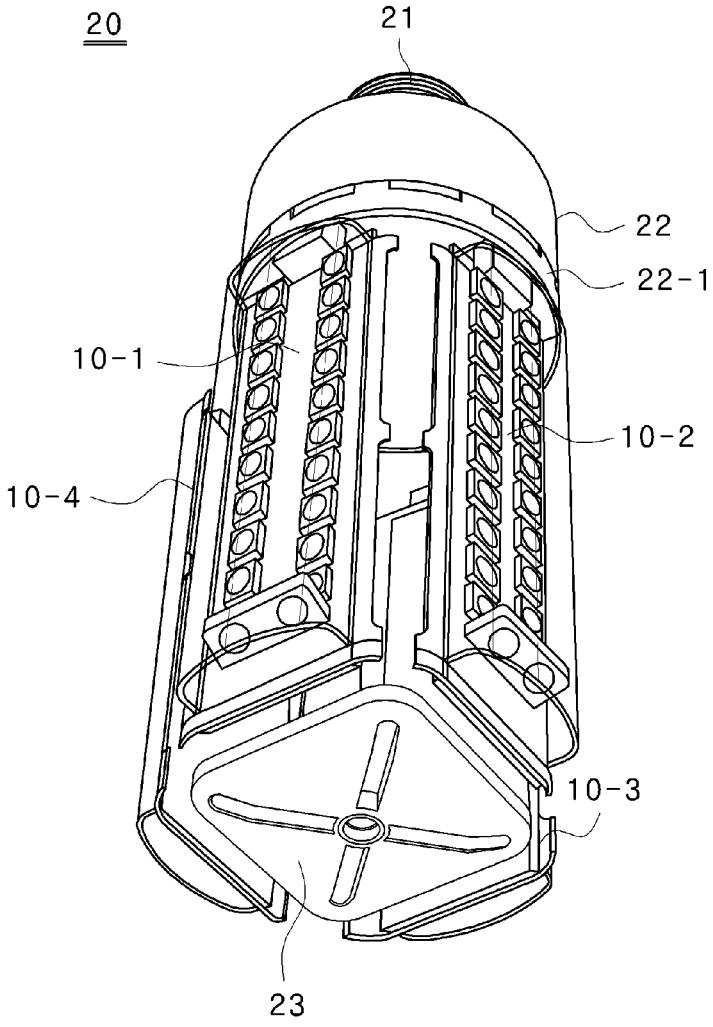
FIG. 5 is a partial exploded view showing a construction in which four LED lighting modules of FIG. 1 are combined to form an LED lighting lamp.
Figure 6:
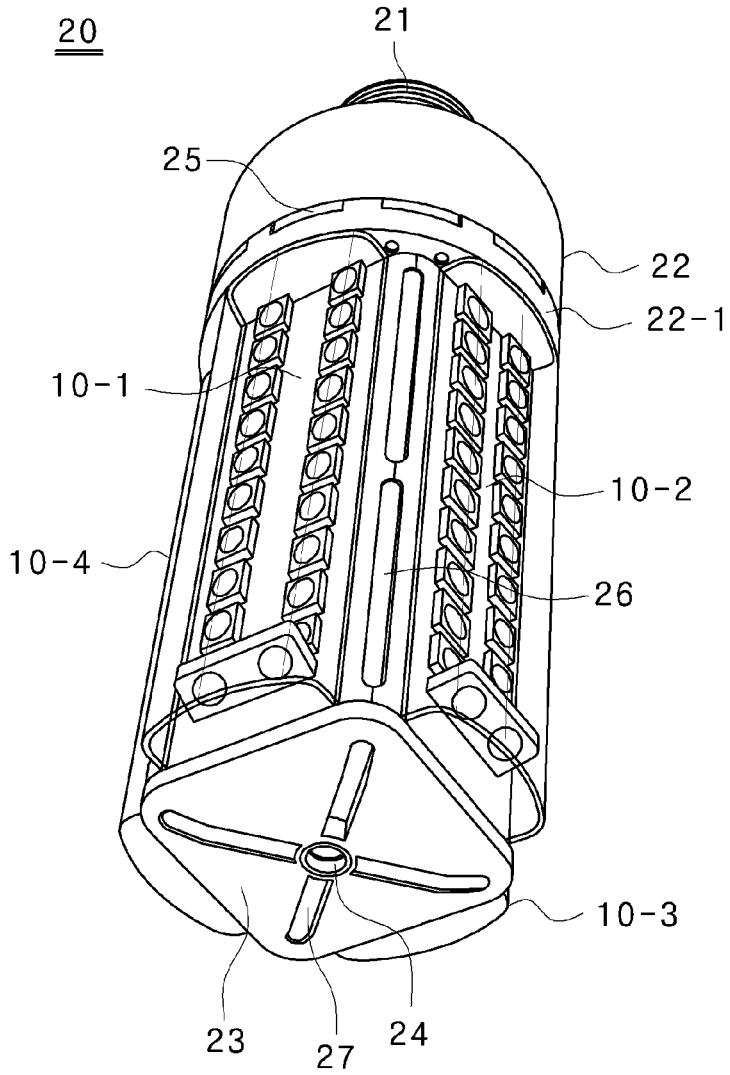
FIG. 6 is a perspective view showing the lighting lamp in accordance with an embodiment of the present invention.
Figure 7:
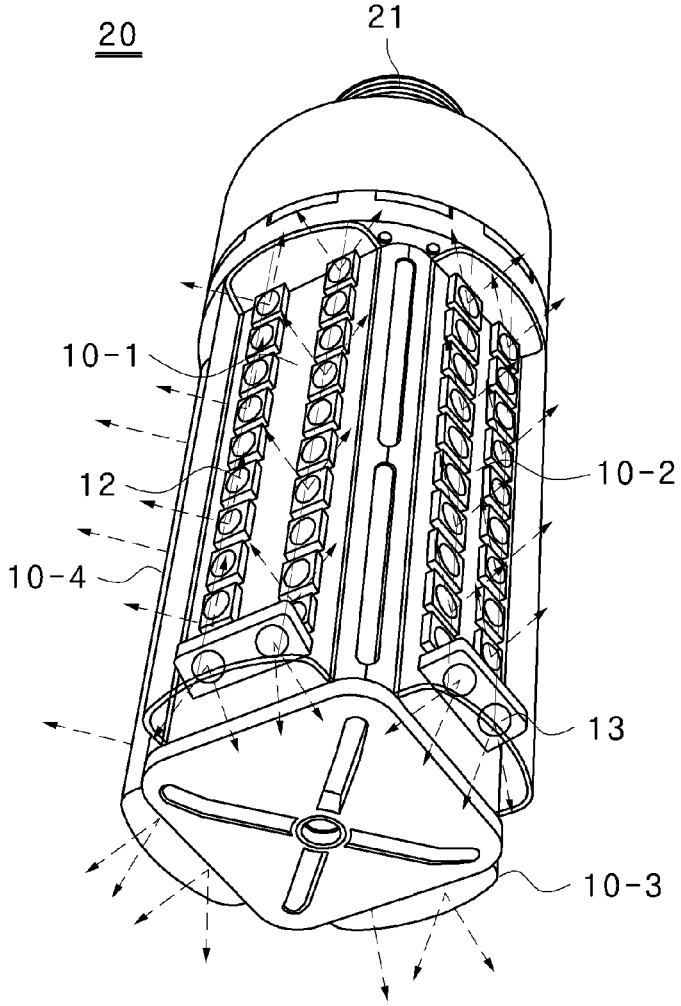
FIG. 7 is a perspective view showing the state in which the lighting lamp of FIG. 6 emits light in all directions.

FIG. 5 is a partial exploded view showing a construction in which four LED lighting modules of FIG. 1 are combined to form an LED lighting lamp, FIG. 6 is a perspective view showing the lighting lamp in accordance with an embodiment of the present invention, and FIG. 7 is a perspective view showing the state in which the lighting lamp of FIG. 6 emits light in all directions.

The lighting lamp using the LED lighting module 20 in accordance with an embodiment of the present invention, as shown in FIGS. 5 and 6, is formed by combining a power module housing 22 having a power connection base 21 fixed to one side thereof, four LED lighting modules 10, 10-1~10-4 shown in FIGS. 1 to 4, and a bottom cover 23 into one.

The construction and operation of the lighting lamp using the LED lighting module 20 in accordance with the present invention are described in detail below. The lighting lamp includes the power module housing 22 configured to have the power connection base fixed on one side thereof, a power module installed within the power module housing 22, a circular shielding plate 28 configured to cover the lower portion of the power module, fixed to the power module housing 22, and configured to have a plurality of holes for connectors formed on its circumference, a housing cover 22-1 configured to cover the circular shielding plate 28, fixed to the power module housing 22 and configured to have a plurality of vent holes 25 formed on its edges and lower circumference and have two or more module insertion holes formed on the circumference of a bottom surface thereof, the LED lighting modules 10, 10-1~10-4 inserted into and fixed to the two or more module insertion holes of the housing cover 22-1, connected to the power module and a power source by the connectors, and shown in FIGS. 1 to 4, wherein the two or more LED lighting modules 10, 10-1~10-4 are inserted into the module insertion holes of the housing cover 22-1 to form a light-emission unit of a polygonal structure, a plurality of vent holes 26 for heat dissipation formed at the respective joint surfaces of the sides at which the projection type wings formed on the left and right sides of the LED lighting modules 10, 10-1~10-4 come in contact with each other when the light-emission unit is assembled, and the bottom cover 23 detachably and attachably combined to the lower side of the LED lighting modules 10, 10-1~10-4, configured to support an assembled light-emission unit, and configured to have one or more vent holes 27 for heat dissipation formed in its bottom surface, so that backlight of 180 degrees and heat is dissipated by convection current in all directions.

In the embodiment of the present invention, if the four LED lighting modules 10-1~10-4 are combined with the bottom of the housing cover 22-1 in a cylindrical shape and the bottom of the lighting modules are fastened by the bottom cover 23 as in FIG. 5, the lighting lamp 20, such as that shown in FIG. 6, is completed. The plurality of vent holes 26 is lengthily formed at the edge of the side in each of the LED lighting modules 10-1~10-4 by the projection wings 16 formed on the left and right sides. The vent holes 25 of the housing cover 22-1 formed at the top and the vent holes 27 formed in the bottom cover 23 form an air passage within the lighting lamp. Thus, radiation heat generated when the LED lighting modules 10-1~10-4 emit light is rapidly dissipated by convection current through the vent holes. Accordingly, the light efficiency and lifespan of the lighting lamp is maintained stably for a long period. A heat dissipation action that is performed by convection current through the vent holes irrespective of a direction in which the lighting lamp is used is described in more detail below with reference to FIGS. 8 to 10.

In the embodiment of the present invention, FIG. 7 shows the state in which the lighting lamp emits light in all directions. The plurality of vertical projection type LED elements 12 arranged within each of the LED lighting modules 10-1~10-4 projects light sources in each lateral direction of the lighting lamp 20, and each of the side projection type LED elements 13 projects a light source in the downward direction of the lighting lamp 20. Accordingly, a lighting effect in which wide backlight of 180 degrees is performed even when an additional light-emitting body is provided at the bottom can be obtained.

Furthermore, it is preferred that the bottom cover 23 be made of the same light diffusion material as the light diffusion cover 15 in order to prevent a shadow occurring due to the introduction of the light-emission light sources of the LED lighting modules 10-1~10-4.

Furthermore, the LED lighting modules 10-1~10-4 standardized by properly distributing side projection light and downward projection light depending on a use of lighting can be fabricated, and the lighting lamp having an appropriate backlight curved line can be fabricated by selecting the LED lighting modules according to a use of lighting. Accordingly, it is preferred that the side projection type LED element 13 be provided as an integrated package in which a plurality of LED elements is combined to have a variety of light outputs and be provided in the LED lighting module 10.

Figure 8:
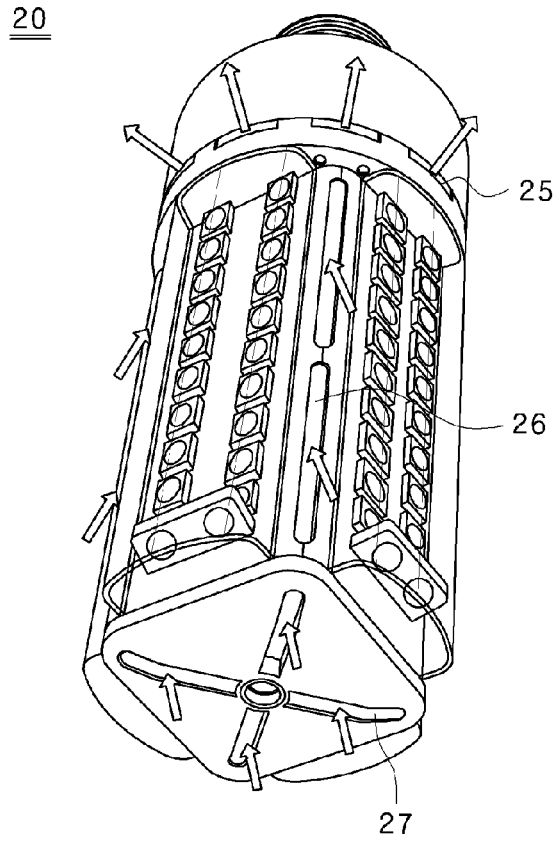
FIG. 8 is a perspective view showing the state in which heat from the lighting lamp of FIG. 6 is dissipated by convection current through vent holes.
Figure 9:
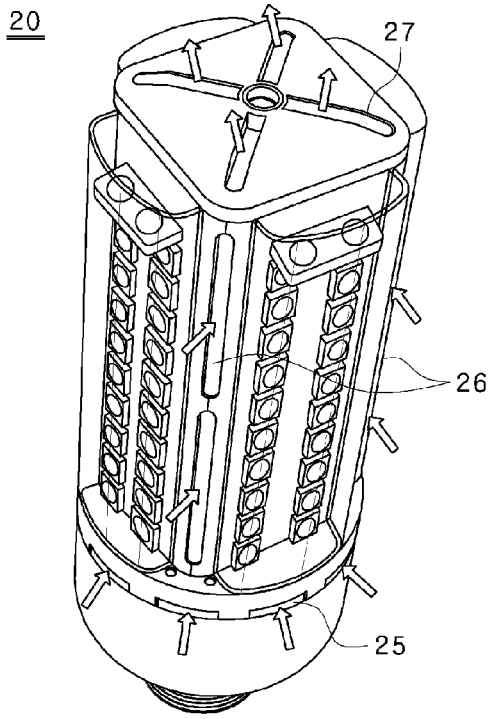
FIG. 9 is a perspective view showing the state in which heat from the lighting lamp is dissipated by convection current through vent holes when the lighting lamp of FIG. 6 is upwardly mounted on a socket.
Figure 10:
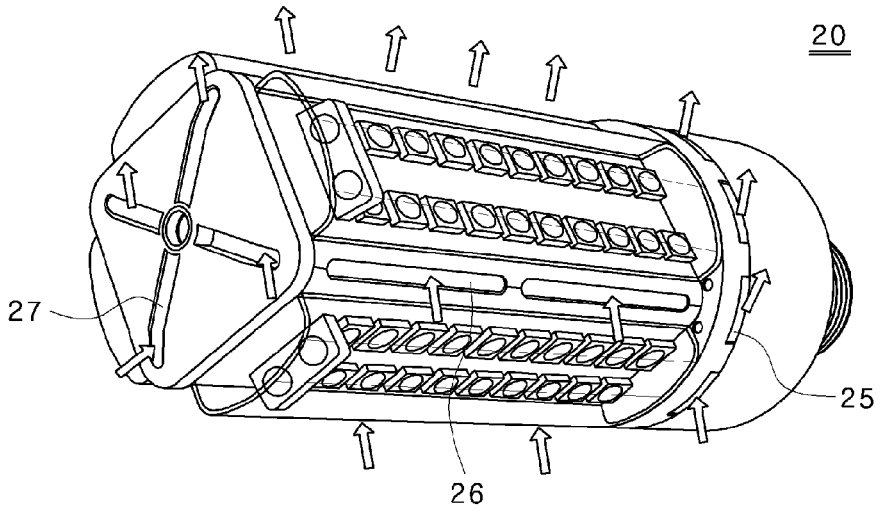
FIG. 10 is a perspective view showing the state in which heat from the lighting lamp is dissipated by convection current through vent holes when the lighting lamp of FIG. 6 is horizontally mounted on a socket.

FIG. 8 is a perspective view showing the state in which heat from the lighting lamp of FIG. 6 is dissipated by convection current through the vent holes, FIG. 9 is a perspective view showing the state in which heat from the lighting lamp is dissipated by convection current through the vent holes when the lighting lamp of FIG. 6 is upwardly mounted, and FIG. 10 is a perspective view showing the state in which heat from the lighting lamp is dissipated by convection current through the vent holes when the lighting lamp of FIG. 6 is mounted in a horizontal direction. In the drawings, an empty arrow indicates the flow of convection air.

In the embodiment of the present invention, as shown in FIGS. 8 to 10, even when the lighting lamp of the present invention is mounted and used in any direction like in the existing electric lamp or compact type fluorescent lamp, the dissipation of heat is smoothly performed and thus the lifespan of the lighting lamp is not deteriorated. In order to achieve this object, the lighting lamp 20 in accordance with the present invention includes the plurality of vent holes 26 formed at the side edges of the light-emission units, the plurality of vent holes 25 formed in the housing cover at the top, and the plurality of vent holes 27 formed at the bottom cover. Accordingly, when the lighting lamp 20 emits light, internal air heated by heat generated from the LED lighting modules 10-1~10-4 generates a convection current action due to a temperature difference, so that the heat is rapidly discharged through the plurality of vent holes.

Accordingly, the lighting lamp 20 in accordance with the present invention dissipates heat generated from the LED lighting modules 10-1~10-4 by convection current through the plurality of vent holes 25~27 by switching heat energy to radiation heat energy using the thin and light heat dissipation plate 19 on which a small amount of heat dissipation material is coated without using a conventional heavy and bulky heat sink made of aluminum in order to solve the amount of heat generated from the LED lighting modules 10-1~10-4. Accordingly, the lighting lamp 20 is useful economically because the lighting lamp can be fabricated more lightly and cheaply.

In the embodiment of the present invention, FIG. 8 shows the state in which heat from the lighting lamp 20 is dissipated by convection current through the vent holes when the lighting lamp is mounted on the power socket of a ceiling. If the internal air of the light-emission units is heated by heat generated from the LED lighting modules 10-1~10-4, when the hot air is discharged through the vent hole 25 of the housing cover at the top, surrounding air is introduced through the vent holes 26 at the side edges of the lighting lamp 20 and the vent holes 27 at the bottom cover. Accordingly, the heat dissipation problem of the lighting lamp is solved because convection current and heat dissipation actions are rapidly performed.

FIG. 9 shows the state in which heat from the lighting lamp 20 of FIG. 6 is dissipated by convection current through the vent holes when the lighting lamp 20 is upwardly mounted on a power socket. Unlike FIG. 8, this drawing shows that external air introduced through the vent holes 26 formed at the side edges of the lighting lamp 20 and the vent holes 25 formed at the housing cover on the lower side is discharged through the vent holes 27 formed at the bottom cover by a convection current action.

FIG. 10 shows the state in which heat from the lighting lamp 20 is dissipated by convection current through the vent holes when the lighting lamp is horizontally mounted on the power socket as in the case where the lighting lamp is installed on the surface of a wall. This drawings shows that external air introduced through vent holes which are formed on the lower side of the vent holes 26 formed at the side edges of the lighting lamp 20, the vent holes 27 formed at the bottom cover, and the vent holes 25 formed at the housing cover is discharged through vent holes which are formed on the upper side thereof.

Figure 11:
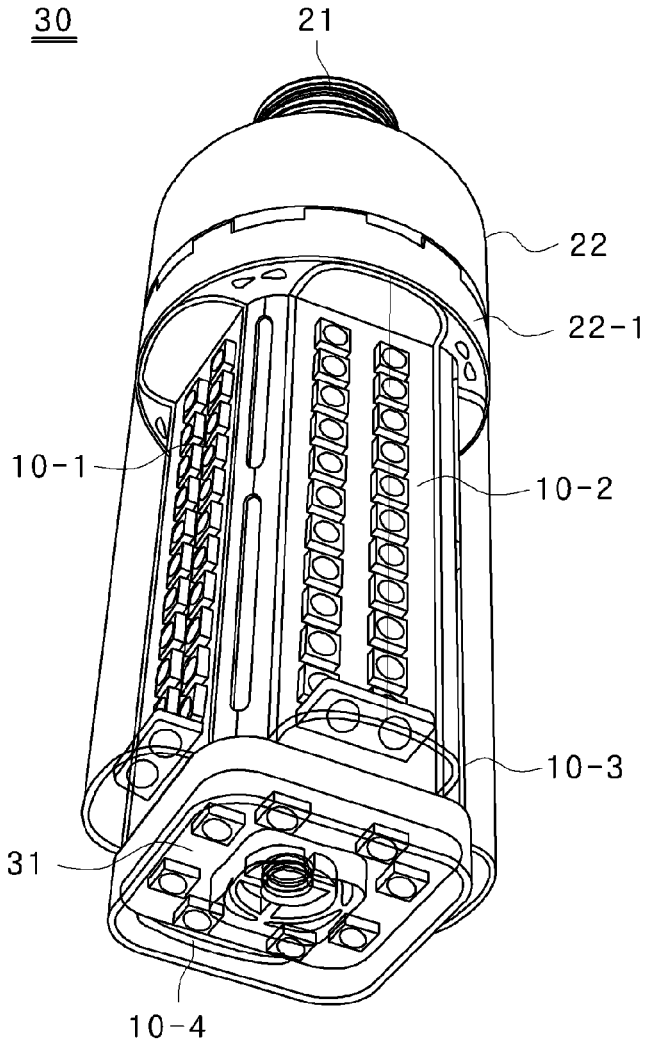
FIG. 11 is a perspective view showing a lighting lamp in accordance with another embodiment of the present invention.
Figure 12:
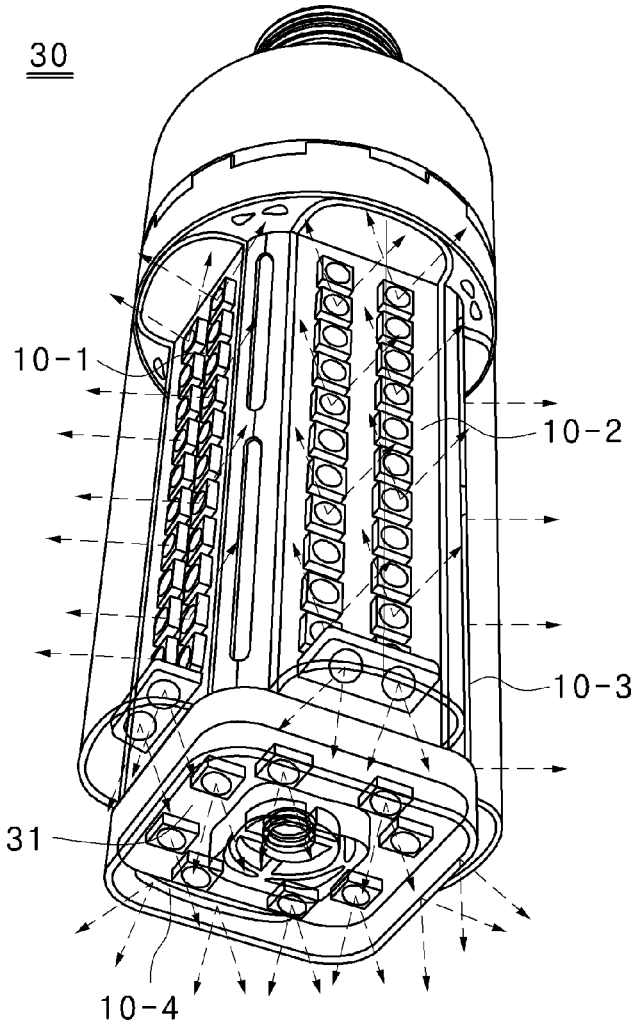
FIG. 12 is a perspective view showing the state in which the lighting lamp of FIG. 11 emits light in all directions.
Figure 13:
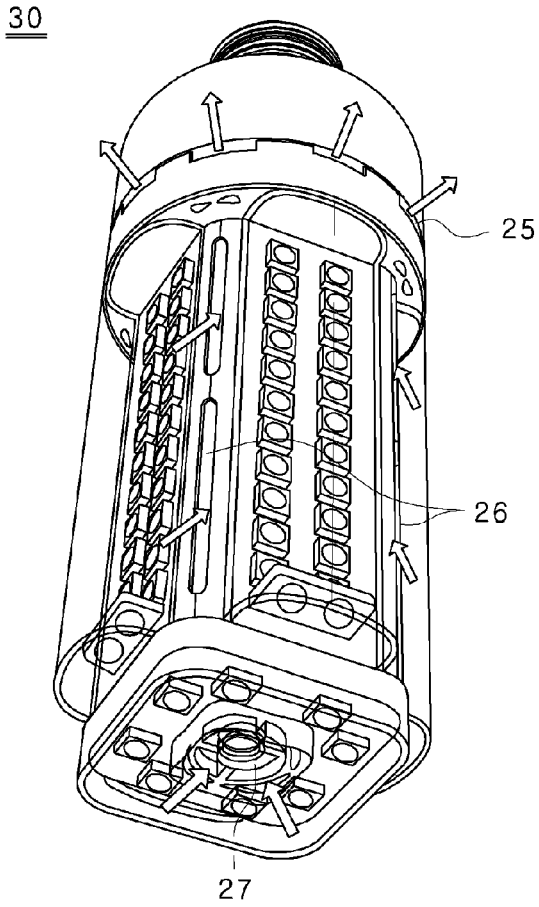
FIG. 13 is a perspective view showing the state in which heat from the lighting lamp of FIG. 11 is dissipated by convection current through vent holes.

FIG. 11 is a perspective view showing a lighting lamp in accordance with another embodiment of the present invention, FIG. 12 is a perspective view showing the state in which the lighting lamp of FIG. 11 emits light in all directions, and FIG. 13 is a perspective view showing the state in which heat from the lighting lamp of FIG. 11 is dissipated by convection current through vent holes.

A lighting lamp 30 using LED lighting modules in accordance with another embodiment of the present invention is formed by combining a power module housing 22 configured to have a power connection base 21 fixed to one side thereof, the four LED lighting modules 10, 10-1~10-4 shown in FIGS. 1 to 4, and a bottom cover 31 equipped with a doughnut-shaped lighting module into one, as shown in FIGS. 11 to 13.

In another embodiment of the present invention, the lighting lamp 30 shown in FIGS. 11 to 13 generally has the same construction and operation of the lighting lamp 20 shown in FIGS. 5 to 10 and differs from the lighting lamp 20 in that the bottom cover 23 of the lighting lamp 20 not having a light emission function is replaced with the bottom cover 31 equipped with the doughnut-shaped lighting module having a light emission function so that the amount of light of lighting that is projected downwardly from the lighting lamp 30 is greatly improved.

Accordingly, a description of portions redundant with the construction and operation of the lighting lamp 20 is omitted, and the construction and operation of the bottom cover 31 equipped with the doughnut-shaped lighting module mounted at the bottom of the lighting lamp 30 configured to emit light through five faces is described in detail. A lattice type vent hole is formed at the center of the bottom cover and configured to introduce external air or discharge internal heat depending on a direction in which the lighting lamp 30 is used. The doughnut-shaped LED lighting module for projecting a lighting light source downwardly is provided within a doughnut-shaped bottom cover and is harmonized with the four LED lighting modules 10-1~10-4 included in the side light-emission units, thereby embodying the lighting lamp 30 having uniform backlight of 180 degrees as in FIG. 12.

In the embodiment of the present invention, in the doughnut-shaped LED lighting module, a plurality of LED elements is arranged in a circuit board in which the central part of a disk-shaped heat dissipation circuit board is perforated in a doughnut shape, the doughnut-shaped circuit board is covered with a doughnut-shaped bottom cover, a power source is supplied through an electric wire connected to at the ends of the LED lighting modules 10-1~10-4, and the LED lighting modules emit light to illuminate the downward side of the lighting lamp 30.

In the embodiment of the present invention, FIG. 13 shows the convection current light emission state of the lighting lamp 30. Vent holes 25~27 become external air inlet ports or internal air exit ports depending on a direction in which the lighting lamp 30 is used, and convection current and heat dissipation actions according to the direction of use are the same as those of FIGS. 8 to 10.

Figure 14:
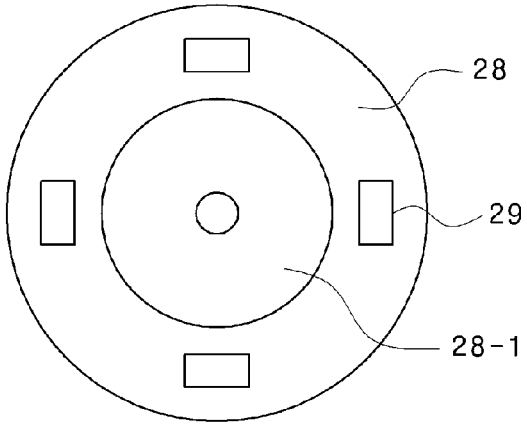
FIG. 14 is a plan view showing a circular shielding plate for shielding the bottom of the power module of the lighting lamps of FIGS. 6 and 11.
Figure 15:
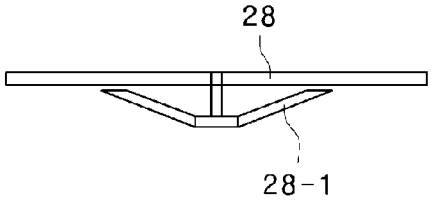
FIG. 15 is a longitudinal cross-sectional view of the circular shielding plate showing the cross section of a heat-blocking cover that is provided at the central part of the circular shielding plate shown in FIG. 14.

FIG. 14 is a plan view showing a circular shielding plate for shielding the bottom of the power module of the lighting lamp of FIGS. 6 and 11, and FIG. 15 is a longitudinal cross-sectional view of the circular shielding plate showing the cross section of a heat-blocking cover that is provided at the central part of the circular shielding plate shown in FIG. 14.

In the embodiment of the present invention shown in FIGS. 5 to 13, it is preferred that a heat-blocking cover 28-1 for blocking radiation heat that rises from the inside of the light-emission units of the lighting lamp 20, 30 to the circular shielding plate 28 and for rapidly switching the direction of emission heat to the vent holes on the side of a housing cover 22-1 be further provided at the center of a circular shielding plate 28 fixed to an inner edge on the lower side of the power module housing 22 and configured to protect an embedded power module from external induction voltage by electrically shielding the power module.

In the embodiment of the present invention, connector holes 29 shown in the circular shielding plate 28 are formed to easily connect connectors, connected to the power module, to the connectors of the respective lighting modules 10-1~10-4 through the respective connector holes 29 of the circular shielding plate 28.

In the embodiment of the present invention shown in FIGS. 5 to 13, a photo sensor 24 for controlling lighting is provided at the bottom cover 23, 31 and configured to automatically control lighting luminance depending on the amount of external light. To detect the amount of light using the photo sensor and automatically control luminance through the power module is a well known circuit technique, and a detailed description thereof is omitted. Furthermore, the photo sensor 24 can also be used as the reception sensor of a common remote controller. In this case, a user can manually change lighting luminance and color rendering by manipulating the remote controller and thus the utilization of the lighting lamp of the present invention is preferably improved. Furthermore, this is a widely known circuit technique, and a detailed driving circuit and a description thereof are omitted.

In the embodiments of the present invention described above, the LED lighting modules 10, 10-1~10-4 mounted on the cylindrical light-emission unit of each of the lighting lamps 20 and 30 illuminate the lateral circumference of each of the lighting lamps 20 and 30. Here, a light source emitted from the side projection type LED element 13 provided on one side of each of the LED lighting modules 10, 10-1~10-4 projects a lighting light source downwardly from each of the lighting lamps 20 and 30 so that backlight of 180 degrees is performed. Accordingly, it is very useful because there is no light blind spot in the light-emission unit.

In the embodiments of the present invention described above, the LED lighting modules 10, 10-1~10-4 can be easily replaced by detaching and attaching the housing cover 22-1 and the bottom covers 23 and 31 if the lifespan of the lamp expires. Wastes can be reduced and resources can be reduced because the lighting lamp housing and parts thereof used in the lighting lamps 20 and 30 of the present invention as main body can be reused semi-permanently.

A person having ordinary skill in the art to which the present invention pertains can modify and embody the present invention in various ways without departing from the gist of the claims, and the scope of the present invention is not restricted by the specific preferred embodiments.

[Industrial Applicability]

The present invention relates to compact type LED lighting lamp capable of replacing the existing electric lamp and fluorescent lamp and a lighting lamp having a significant power-saving effect and a semi-permanent and long lifespan by using LED elements of semiconductors in which pollutants, such as mercury, are not used as a light-emitting body. Accordingly, the LED lighting lamp of the present invention can reduce wastes and resources and can be widely used industrially.

The invention claimed is:

1. A lighting lamp, comprising:

a power module housing configured to have a power connection base fixed on one side thereof;

a power module installed within the power module housing;

a circular shielding plate configured to cover a lower portion of the power module, fixed to the power module housing, and configured to have a plurality of holes for connectors formed on its circumference;

a housing cover configured to cover the circular shielding plate, fixed to the power module housing, and configured to have a plurality of vent holes formed on its edges and lower circumference and have two or more module insertion holes formed at a bottom surface thereof;

two or more LED lighting modules inserted into and fixed to the module insertion holes of the housing cover and connected to the power module and a power source by the connectors, each of the two or more LED lighting modules comprising:

a LED module configured to have a plurality of LED elements arranged in a circuit board having a connector for power connection provided on one side thereof and formed of a surface light-emission body;

a light diffusion cover configured to cover an upper side of the LED module in a semi-cylindrical shape and have projection type wings formed on left and right sides thereof, respectively; and a heat dissipation plate combined to cover a lower side of the LED module, configured to have an edge thereof inserted into a bottom edge of the light diffusion cover and fixed to a bottom of the light diffusion cover, and made of metal, wherein the LED module, the light diffusion cover, and the heat dissipation plate are integrally combined, and wherein the two or more LED lighting modules are inserted into the module insertion holes of the housing cover to form a lamp type light-emission unit of a polygonal structure;

a plurality of vent holes for heat dissipation formed at edges on left and right sides of each of the two or more LED lighting modules so that the projection type wings formed on left and right sides of each of the two or more LED lighting modules come in contact with each other when the two or more LED lighting modules are combined to form a cylindrical light-emission unit; and a bottom cover detachably and attachably combined to a lower side of the two or more LED lighting modules and configured to support an assembled light-emission unit and have one or more vent holes for heat dissipation formed in its bottom surface, so that wide angle light distribution is performed and heat is dissipated by a convection current in all directions.

2. The lighting lamp according to claim 1, wherein:

a doughnut-shaped bottom cover having a lattice type vent hole formed at a center of the bottom cover is provided instead of the bottom cover, and the bottom cover equipped with a doughnut-shaped LED lighting module for projecting a lighting light source in a downward direction is provided within the doughnut-shaped bottom cover.

3. The lighting lamp according to claim 1, further comprising a heat-blocking cover disposed within the light-emission unit of the lighting lamp at the center of the circular shielding plate and configured to block radiation heat rising toward the circular shielding plate and switch a direction of emission heat to side vent holes of the housing cover.

4. The lighting lamp according to claim 1, wherein:

the two or more LED lighting modules mounted on the cylindrical light-emission unit of the lighting lamp illuminate respective side circumferences of the lighting lamp, and a light-emission light source of a side projection type LED element provided on one side of each of the two or more LED lighting modules projects a lighting light source toward a downward direction of the lighting lamp so that the wide angle light distribution is performed.

5. The lighting lamp according to claim 1, wherein:

the bottom cover comprises a photo sensor for automatically controlling luminance, and lighting luminance and color rendering are changed by a manipulation of a remote controller through the photo sensor.

6. The lighting lamp according to claim 1, wherein each of the two or more LED lighting modules is easily replaceable by attaching or detaching the housing cover and the bottom cover.

* * * * *